US006595124B1

(12) United States Patent
Mansuroglu

(10) Patent No.: US 6,595,124 B1
(45) Date of Patent: Jul. 22, 2003

(54) MULTICHAMBER PRESS

(75) Inventor: Mehmet Ali Mansuroglu, Wadersloh (DE)

(73) Assignee: Robert Burkle GmbH, Freudenstadt (DE)

( * ) Notice: Subject to any disclaimer, the term of this patent is extended or adjusted under 35 U.S.C. 154(b) by 38 days.

(21) Appl. No.: 09/688,264

(22) Filed: Oct. 13, 2000

(51) Int. Cl.[7] ..... B30B 15/02

(52) U.S. Cl. ..... 100/225; 100/195; 100/258 A; 100/203

(58) Field of Search ..... 100/195, 194, 100/203, 225, 199, 46, 258 R, 258 A; 425/338; 156/58

(56) References Cited

U.S. PATENT DOCUMENTS 3,041,666 A * 7/1962 Dorenbos et al. ..... 100/194
3,788,211 A * 1/1974 Mason, Jr. ..... 100/265
5,234,332 A * 8/1993 Hoenke et al. ..... 100/199

* cited by examiner

*Primary Examiner*—Allen Ostrager
*Assistant Examiner*—Shelley Self
(74) *Attorney, Agent, or Firm*—Herbert Dubno

(57) ABSTRACT

A multichamber press has press platens coupled in pairs and movable toward and away from a stray press plate supported on the upright of the press frame. The outer most press platens for synchronizing device for tilting, the synchronous device having pinions meshing on the upright and connected together with shifts which can be coupled by a further shaft and bevel gearing.

5 Claims, 4 Drawing Sheets

MULTICHAMBER PRESS

FIELD OF THE INVENTION

The present invention relates to a multichamber or multilevel press especially for the hot pressing of plate-shaped or board-shaped workpieces of wood or woody materials which may be covered with films impregnated with or coated by glue, veneers or the like. More particularly this invention relates to a multichamber or multilevel press having a fixed press plate between upper and lower movable platens defining chambers receiving the flat workpiece to be pressed with the press plate and between each other.

BACKGROUND OF THE INVENTION

German Patent Document DE-U 88 06 883 describes a press with two chambers multichamber or multilevel press which comprises a press frame, a press plate or table fixed in this frame, vertically movable press platens above and below the press table and piston-and-cylinder units for displacing the movable press platens.

European Patent Document EP-B 0 384 958 and German Patent Document DE A 4428 786 describe multichamber presses with a number of movable press platens and piston-and-cylinder units whereby the piston-and-cylinder units connect two movable press platens. The piston-and-cylinder units chain the movable press platens together. In accordance with this principle, more than two press chambers can be provided one above another. However, the vertical guidance of the press platens is unsatisfactory in these systems. In EP-B 0 384 958 and DE A 4428 786 there is always the danger that a movable press platen will tilt upon pressing.

OBJECT OF THE INVENTION

It is, therefore, the principal object of the present invention to provide a high capacity multichamber press whereby the danger of platen tilting is eliminated at a modest cost.

More specifically, it is an object of this invention to provide a multichamber or multilevel press, especially for press wood or woody materials with laminates like foils or films coated with glue, or with veneers, whereby drawbacks of earlier systems are avoided.

SUMMARY OF THE INVENTION

These objects and others which will become more readily apparent hereinafter are attained, in accordance with the invention in a multichamber or multilevel press which comprises:

- a press frame having a plurality of uprights;
- a press plate fixedly mounted in the frame and secured to the uprights;
- a plurality of vertically movable press platens received in the frame and including movable press platens above and below the press plate and defining pressing chambers with the press plate;
- respective first groups of mutually parallel jointly operable piston-and-cylinder units acting upon the press platens for displacing the press platens toward and away from the press plate and including piston-and-cylinder units braced between the frame and respective ones of the movable press platens proximal to the press plate, the movable press platens including at least one further movable press platen forming a group with a the movable press platen proximal to the press plate and defining at least one further pressing chamber therewith;

- at least one second group of mutually parallel jointly operable piston-and-cylinder units braced between the further movable press platen and the press platen defining the further chamber therewith for expanding and contracting the further chamber;
- a respective mechanical synchronizing device on each of the movable press platens most distal from the press plate for vertically guiding the movable press platens, the mechanical synchronizing devices including:
  - a plurality of gears spaced from one another on outer sides of the respective movable press platen,
  - shafts rigidly interconnecting the gears, and
  - racks on the uprights meshing with the gears; and
- control means coupled with the groups of piston-and-cylinder units for selectively and alternatingly opening and closing the chambers.

With the system of the invention, above and/or below the fixed press table or press plate, a press platen arrangement is provided which has at least two movable press platens disposed one above the other at movable press platens being interconnected by a group of piston-and-cylinder units operated in parallel and the press platen of the group of press platens which is most distal from the stationary press plate is provided with a mechanical synchronizing unit for vertical guidance of the movable press platens.

According to the invention, the synchronizing device comprises gears or pinions which are spaced apart on the outer sides of the outer most movable press platens, namely, the press platens most distal from the stationary press plate and these pinions are rigidly interconnected by respective shafts and roll on and mesh with respective racks on the uprights of the press frame. The apparatus also includes means for alternatingly and selectively opening and closing the press chambers formed by the movable platens. The movable press platens on each side of the stationary press plate are chained together by respective groups of piston-and-cylinder units.

Each thus coupled group of press platens is connected by the first group of piston-and-cylinder units to a rigid part of the press, namely, to the frame which in turn is rigidly connected to the press table or press plate.

Surprisingly, it has been found that the synchronizing device need only be provided on the movable press platen most distal from the press plate among the press platens of the group on the respective side of the press plate and suffices to guide all of the movable press platens on that side of the press plates when the press chambers are alternatingly opened and closed.

If a press chamber between movable press platens is closed, with a workpiece in that chamber to be pressed by the press platens, that assembly of closed press platens and workpiece forms a guide which maintains parallelism with any movable press platens connected thereto and thus the synchronizing device on that unit functions to maintain synchronized closing of all other chambers on that side of the press plate. Parallelity is thus maintained between all of the press platens on the respective side of the press plate in spite of the fact that only a single synchronizing unit is provided on each side.

The mechanical synchronizing unit is so dimensioned that any nonuniform pressure distribution developed in the pressing operation can be compensated by a mechanical redistribution. It has been found to be advantageous to connect the gears at the outer edges of the respective movable press platen by two parallel rigid shafts and to couple the two parallel shafts with each other by bevel gearing and a coupling shaft.

While there is the danger of overloading if a foreign body is found in the press chamber during the press operation, according to the invention an emergency switching can be effective by providing the bearing housing for one of these shafts if a two part housing with one part connected to the movable platen and the other part braced thereagainst under spring loading. The movable part of the bearing housing can be connected with a switch which can issue a stop command in the case of such an overload. If there is a tendency of one of the movable press platens to tilt, therefore, the movable bearing housing half will trigger the switch and produce the stop signal.

The synchronizing devices have further guide rollers which are at a right angle to the respective gear wheels or pinions and ride upon something or planar tracks on the uprights or columns. The columns may be spaced apart along the longitudinal sides of the press plate and connected therewith by bolting or welding and the first group of piston-and-cylinder units can be braced against these columns.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
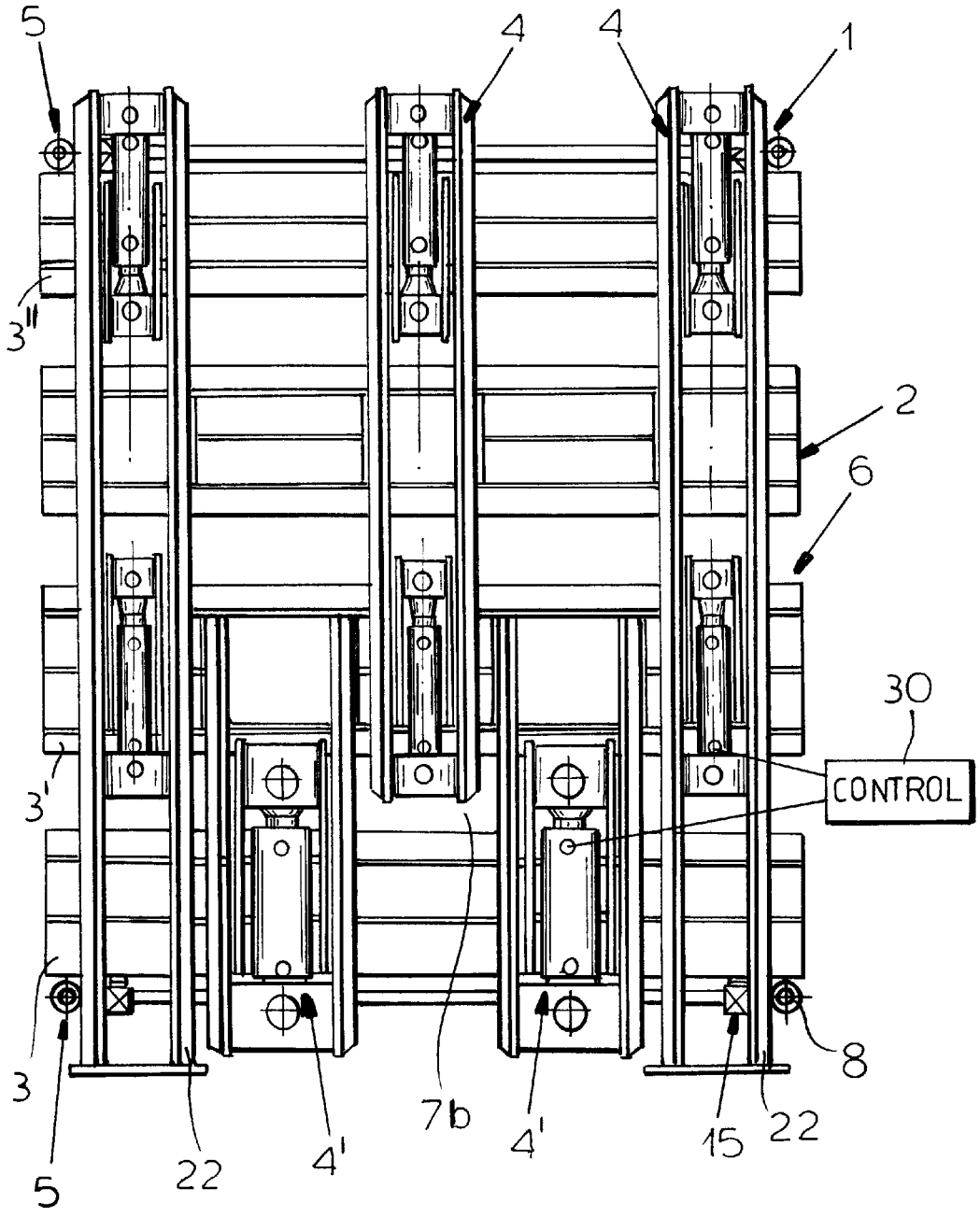
FIG. 1 is a side elevational view of a multilevel and multichamber press according to the invention.

The multichamber and multilevel press shown in the drawing can be used for the hot pressing of boards of wood or woody materials to which are applied films or foil coated with glue, the rear which has been coated with glue or the like. Where foil or veneers are used, the press is a laminating press.

The basic construction of the press comprises a press frame 1 in which a press table or press plate 2 is fixedly mounted, e.g. by being bolted or welded to the column 22 of the press frame.

The press also includes vertically movable press platens 3, 3', 3" above and below the press plate 2. Piston-and-cylinder devices 4, 4' are provided for vertically displacing the press platens and mechanical synchronization devices 5 are provided for insuring the vertical displacement of the movable press platens, i.e. the displacement of the press platens parallel to themselves and to the fixed press plate 2. Above and below the fixed press plate are respective groups each constituted of a plurality of piston-and-cylinder units 4 pressed against the press frame on one side and connected to one of the press platens 3', 3" proximal to the press plate 2 on the other side.

Below the fixed press plate 2, two movable press platens 3, 3', disposed one above the other, forms a group or assembly 6 of press platens which define a respective press chamber 7*b* between them. Between the proximal press platen 3' and the press plate 2, the first pressing chamber 7*a* is defined. The two pressing chambers 7*a* and 7*b* of the assembly 6 are alternately opened and closed and for this purpose a press control 30 can be connected to the piston and cylinder units 4, 4'.

As is also especially apparent from FIG. 1, the two press platens 3, 3' of the assembly 6 are coupled by a number of piston-and-cylinder units 4' which are connected in parallel and can alternate with the piston-and-cylinder units 4 which are braced against the machine frame 1 and act on the movable press platen 3'.

On the outer side of the uppermost press platen 3" and on the outer side of the lowermost press platen 3 of the multichamber press, respective mechanical synchronizing units 5 are provided which insure, during press operation, that the movable platens will be maintained parallel to themselves and each other. The details of the synchronizing device 5 will be apparent from FIG. 2.

The synchronizing device 5 comprises gear wheels or pinions 8 which are spaced apart and are mounted on shafts 9 which are parallel to one another and connect two gears at opposite corners of the press platen, the shafts 9 running along the small edges of the press platen transverse to the longitudinal direction. The shafts 9 are connected by bevel gears represented at 12 with a coupling shaft 10, also journalled in bearings on the press platen.

The pinions 8 mesh with vertical racks 11 on the columns 22. The rigid connection of the pinions with one another as the platens rise and fall in the frame prevent tilting of the press platens during the press operations.

Figure 2:
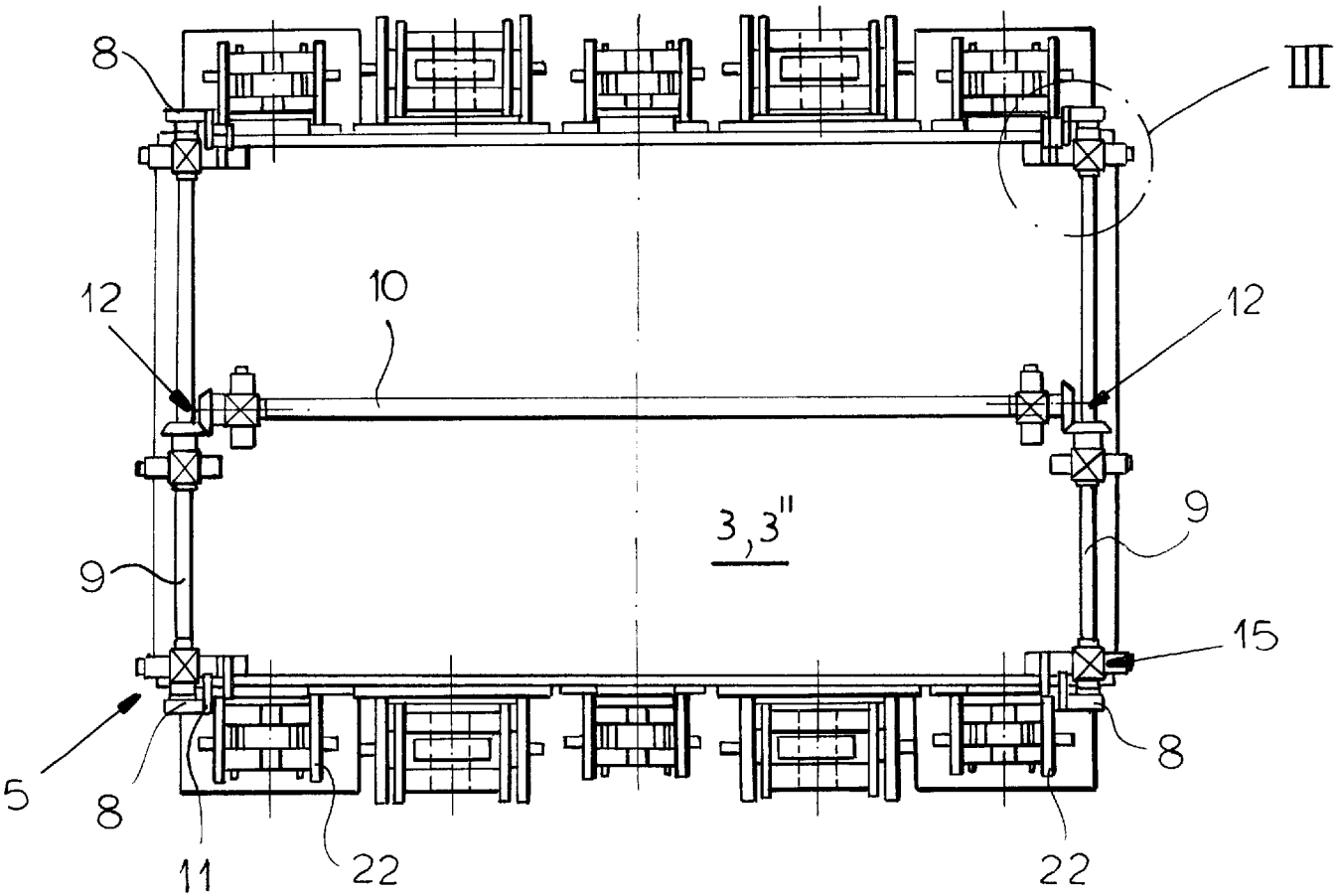
FIG. 2 is a plan view of the press shown in FIG. 1.
Figure 3:
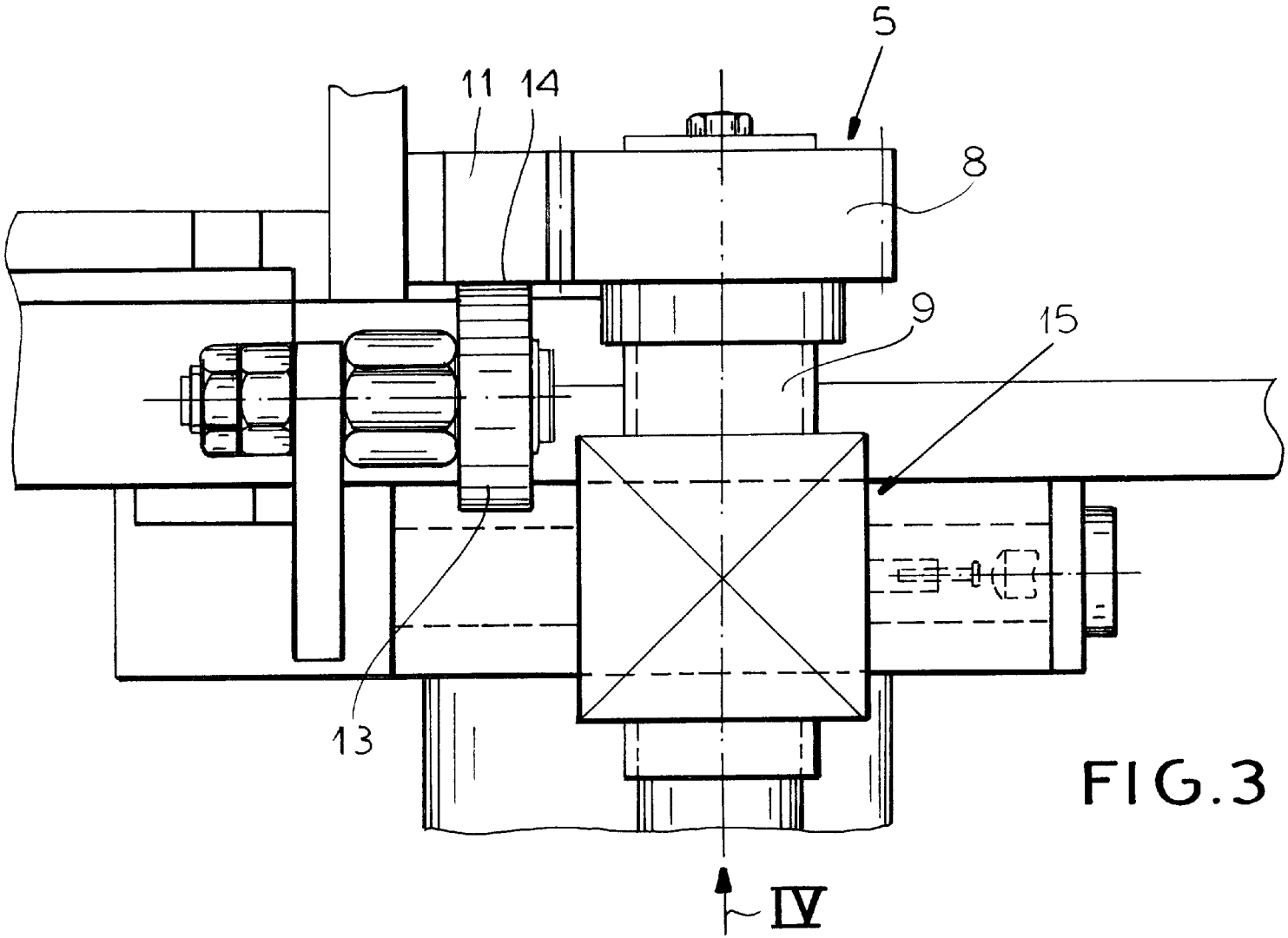
FIG. 3 is a detail of the region III of FIG. 2.

For guidance in the transverse direction, guide rollers 13 are provided for the press platens, the guide rollers 13 lying at a right angle to the pinions 8 and riding on planar tracks 14 formed on the columns 22, e.g. along a flank of the respective rack 11 (see FIGS. 2 and 3).

Figure 4:
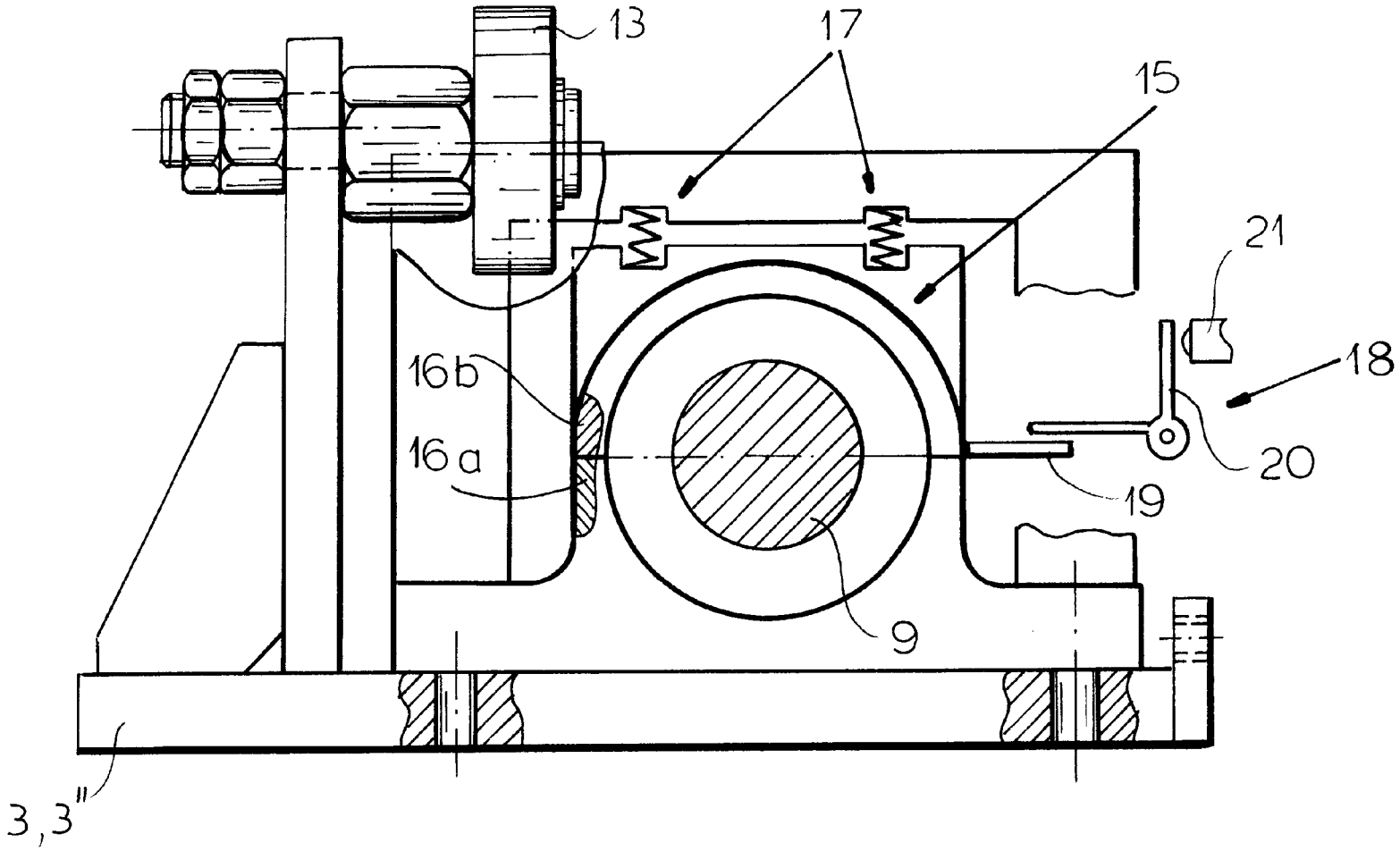
FIG. 4 is a cross sectional view seen in the direction of the arrow IV of FIG. 3.

From FIG. 4, it is possible to see that the bearings 15 of the synchronizing device 5 can be provided with a subdivided bearing housing 16*a*, 16*b*. The lower housing half 16*a* which is stationary and receives the bearing, can be fixed to the press platen 3 or 3". The upper housing half 16*b* is pressed against the lower housing half 16*a* by a prestressed spring arrangement 17. On the upper housing half 16*b* a switching device 18 is provided which can include a switching finger or lug 19, a bell crank lever 20 and an electrical switch 21 which, upon vertical movement of the upper housing half emits a stop signal for immediate termination of the movement of the press platen. The switching device 18 thus prevents damage to the synchronizing device when, for example, during a pressing operation, there is a foreign body in the path of the movable press platen and there is a tendency of the latter to tilt because the forces cannot be compensated or redistributed by the synchronizing device.

From FIG. 1 it will be clear that the two press platens 3 and 3' which form the assembly 6 below the press plate 2 only have a single synchronizing unit 5 which is provided on the outer side of the press platen 3 most distal to the press plate 2. A single synchronizing device 5 is sufficient when the two press chambers 3 and 3' are operated alternatingly. If the two movable press platens are stressed against one another with a workpiece received between them, they form a substantially rigid functional unit whose horizontal orientation is insured during the press operation by the lower synchronizing device 5.

Subsequently, the first press chamber 7*a* between the press plate 2 and the neighboring press platen 3' can be opened and closed. When the first press chamber 7*a* is closed, the stationary press plate 2 and the press platen 3' from, with the intervening workpiece, a functional unit. Then the outer press platen 3 can be opened and the press operation undertaken in the second press chamber 7*b* utilizing the effect of the synchronizing device 5. According to the invention, the synchronizing device 5 is utilized for the movement of the outer press platen 3 alone and for the movement of the two press platens 3, 3' as a stack.

According to the invention, an assembly of press platens like that shown at 6 can also be provided above the fixed press plate 2 and can include 2 or more press platens chained by respective groups of piston-and-cylinder units so that a single synchronizing unit 5 is provided at the upper most press platen.

It is also possible to provide each assembly 6 with more than two movable press platens as long as they are coupled together in pairs. Here again only the outer most press platen need by equipped with a synchronizing device. The control unit can insure that only one press chamber on a side of the press plate 2 is opened at any one time while all other press chambers are closed.

The press plate and the movable press platens can, of course, be heatable and each press chamber can, if desired, be equipped with a conveyor belt or a plurality of conveyor belts to receive two or more workpieces.

The uprights are columns 22 which are spaced apart along the longitudinal side of the press plate 2 and serve to brace the piston-and-cylinder units 4 at one side. The other side of these piston-and-cylinder units can be connected to the respective press platens 3' and 3". With this configuration, upper and lower traverses are eliminated so that the overall effective height of the multichamber press can be increased.

I claim:

1. A multichamber press for pressing flat workpieces, comprising:

a press frame having a plurality of uprights;

a press plate fixedly mounted in said frame and secured to said uprights;

a plurality of vertically movable press platens received in said frame and including movable press platens above and below said press plate and defining pressing chambers with said press plate;

respective first groups of mutually parallel jointly operable piston-and-cylinder units acting upon said press platens proximal to the press plate for displacing said press platens toward and away from said press plate and including piston-and-cylinder units braced between said frame and respective ones of said movable press platens proximal to said press plate, said movable press platens including at least one further movable press platen forming a group with a said movable press platen proximal to said press plate and defining at least one further pressing chamber therewith;

at least one second group of mutually parallel jointly operable piston-and-cylinder units braced between the further movable press platen and the press platen defining said further chamber therewith for expanding and contracting said further chamber;

a respective mechanical synchronizing device on each of said movable press platens most distal from the press plate for vertically guiding the movable press platens, said mechanical synchronizing devices including:

a plurality of gears spaced from one another on outer sides of the respective movable press platen, shafts rigidly-interconnecting said gears, and racks on said uprights meshing with said gears; and control means coupled with said groups of piston-and-cylinder units for selectively and alternatingly opening and closing said chambers, the gears are provided at the ends of two mutually parallel gear shifts on outer sides of the press platens most distal from the press plate and are interconnected by bevel gearing and a coupling shaft, each said synchronizing device being provided with a shaft bearing rotatable in a bearing housing subdivided into a lower housing half and an upper housing half, the respective lower housing half being fixed to the respective press platen, the upper housing half being vertically movable against a prestressed spring arrangement on the lower housing half, each synchronizing device further comprising switch means responsive to the movement of an upper housing half away from the respective lower housing half for generating a stop signal for instantaneously halting the displacement of a movable press platen.

2. The multichamber press defined in claim 1 wherein each synchronizing device has a guide roller oriented at a right angle to the respective gears and rolling on a planar track on a respective one of said uprights.

3. The multichamber press defined in claim 2 wherein said uprights are columns spaced apart along longitudinal sides of said press plate and bolted or welded thereto, the piston-and-cylinder units of said first group being braced on said columns.

4. The multichamber press defined in claim 3 wherein the piston-and-cylinder units braced on said columns engage the movable press platens proximal to said press plate.

5. A multichamber press for pressing flat workpieces, comprising:

a press frame having a plurality of uprights;

a press plate fixedly mounted in said frame and secured to said uprights;

a plurality of vertically movable press platens received in said frame and including movable press platens above and below said press plate and defining pressing chambers with said press plate;

respective first groups of mutually parallel jointly operable piston-and-cylinder units acting upon said press platens proximal to the press plate for displacing said press platens toward and away from said press plate and including piston-and-cylinder units braced between said frame and respective ones of said movable press platens proximal to said press plate, said movable press platens including at least one further movable press platen forming a group with a said movable press platen proximal to said press plate and defining at least one further pressing chamber therewith;

at least one second group of mutually parallel jointly operable piston-and-cylinder units braced between the further movable press platen and the press platen defining said further chamber therewith for expanding and contracting said further chamber;

a respective mechanical synchronizing device on each of said movable press platens most distal from the press plate for vertically guiding the movable press platens, said mechanical synchronizing devices including:

a plurality of gears spaced from one another on outer sides of the respective movable press platen, shafts rigidly interconnecting said gears, and racks on said uprights meshing with said gears; and control means coupled with said groups of piston-and-cylinder units for selectively and alternatingly opening and closing said chambers, each said synchronizing device being provided with a shaft bearing rotatable in a beating housing subdivided into a lower housing half and an upper housing half, the respective lower housing half being fixed to the respective press platen, the upper housing half being vertically movable against a pre-stressed spring arrangement on the lower housing half, each synchronizing device further comprising switch means responsive to the movement of an upper housing half away from the respective lower housing half for generating a stop signal for instantaneously halting the displacement of a movable press platen.

* * * * *